US005829617A

United States Patent [19]

Umiker

[11] Patent Number: 5,829,617

[45] Date of Patent: Nov. 3, 1998

[54] COLLAPSIBLE PLASTIC CONTAINER

[75] Inventor: Hans Umiker, Egg, Switzerland

[73] Assignee: Schoeller International Engineering S.A., Romont, Switzerland

[21] Appl. No.: 817,083

[22] PCT Filed: Oct. 6, 1995

[86] PCT No.: PCT/CH95/00228

§ 371 Date: Jul. 11, 1997

§ 102(e) Date: Jul. 11, 1997

[87] PCT Pub. No.: WO96/11144

PCT Pub. Date: Apr. 18, 1996

[30] Foreign Application Priority Data

Oct. 7, 1994 [CH] Switzerland ..... 94/3023
Dec. 2, 1994 [CH] Switzerland ..... 94/3664

[51] Int. Cl.[6] ..... B65D 6/22

[52] U.S. Cl. ..... 220/6

[58] Field of Search ..... 220/6, 7, 666, 220/4.28, 558, 337, 338

[56] References Cited

U.S. PATENT DOCUMENTS

| | | | |
|---|---|---|---|
| B 513,789 | 2/1976 | Koen . | |
| 3,874,546 | 4/1975 | Sanders et al. | 220/6 |
| 4,181,236 | 1/1980 | Prodel | 220/6 |
| 4,300,695 | 11/1981 | Hsu | 220/6 |
| 5,398,834 | 3/1995 | Umiker | 220/6 |
| 5,588,549 | 12/1996 | Furtner | 220/6 |
| 5,622,276 | 4/1997 | Simmons | 220/6 |

FOREIGN PATENT DOCUMENTS

| | | |
|---|---|---|
| 178 211 | 4/1986 | European Pat. Off. . |
| 404 041 | 12/1990 | European Pat. Off. . |
| 27 34 964 | 2/1979 | Germany . |
| 42 01 145 | 7/1993 | Germany . |

*Primary Examiner*—Stephen J. Castellano
*Attorney, Agent, or Firm*—IP Group of Pillsbury Madison & Sutro LLP

[57] ABSTRACT

Walls of a collapsible plastic container are produced independently of the base (1) of said container and are then plugged together therewith. They are connected to the base via hinges (4) which each, on the one hand, comprise a hinge housing (5), anchored on the base (1), with a push-in section (8) and an end section (10), which are separated by a gap (9), and with a passage (11) which passes through both of these sections, and, on the other hand, comprise a hinge pin (7) which is mounted rotatably in the passage (11) and is connected to the wall via a web-like retaining finger (6). In the region of the push-in section (8), the passage (11) is open at the sides as a result of a push-in slot (12) which tapers towards the gap (9), with the result that, when the wall is plugged together with the base (1), i.e. when the hinge pin (7) is introduced into the passage (11), the retaining finger (6) can be pushed through the push-in slot (12) into the gap (9), where it is secured against sliding back. Separation of the walls from the base, and reassembly, is possible without using a tool.

30 Claims, 12 Drawing Sheets

COLLAPSIBLE PLASTIC CONTAINER

Figure 1:
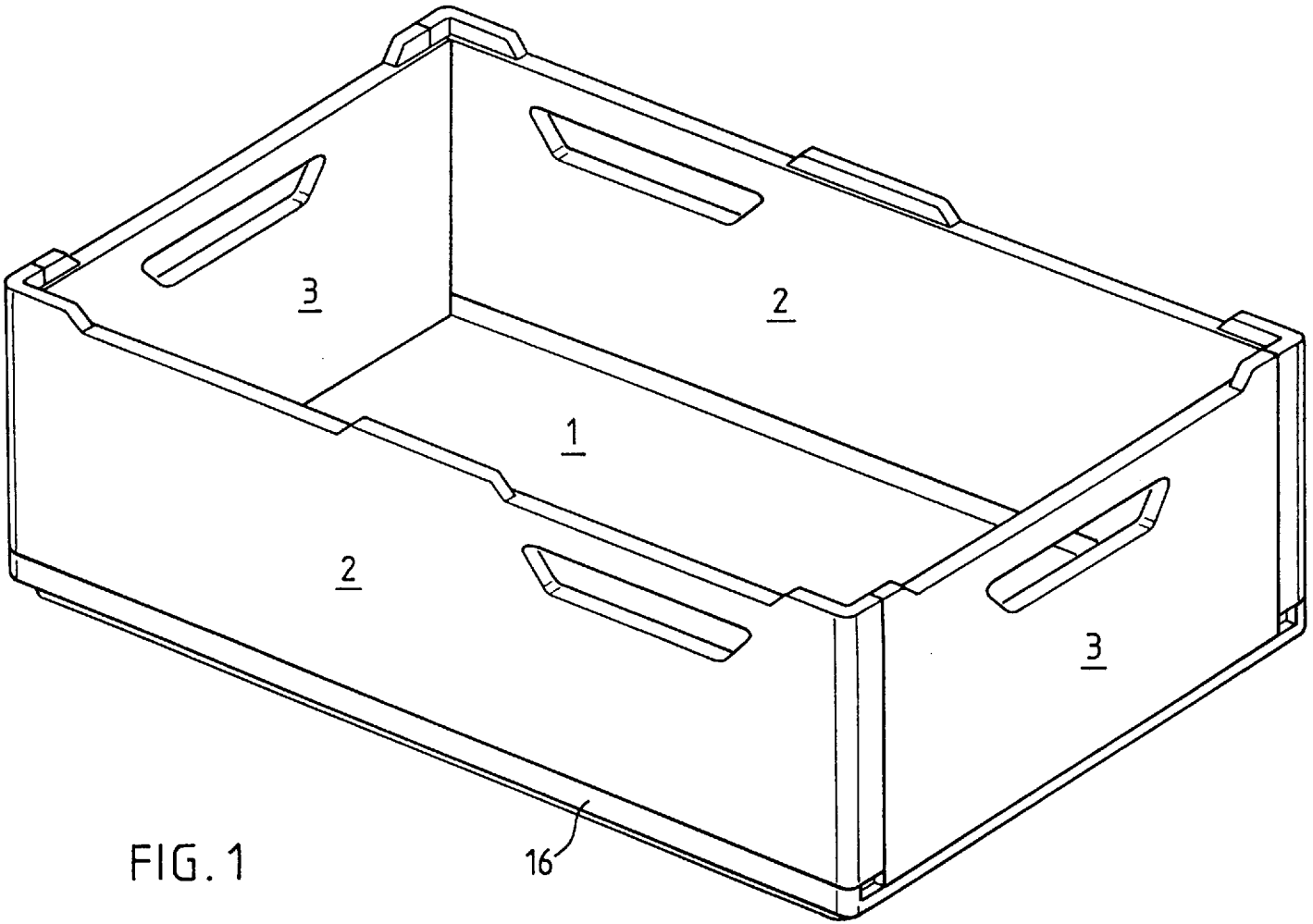

The invention relates to a collapsible plastic container according to the preamble of claim 1. Plastic containers of this type are used for transporting goods, e.g. vegetables. DE-A-42 01 145 discloses a plastic container of this type in which a rectangular base is connected to four outer walls by film hinges.

Although the abovedescribed plastic container has proved successful when put to practical use, its production poses considerable problems. For example, the base and walls have to be produced in one piece, which, on account of the boundary conditions caused by the need for the large area of projection, involves severe restrictions as far as the size of the production machines is concerned.

On account of the high demands which the film hinges have to satisfy, the selection of materials is restricted and high precision is necessary during production. Even if high-quality material is used, it is nevertheless usually the hinges which cause an entire container to fail.

EP-A-0 404 041 discloses a further plastic container of the generic type, in which a rectangular base is connected to two mutually opposite outer walls by hinges. These hinges comprise either a thin strip of plastic (the disadvantages of such film hinges have already been described) or a multiplicity of elements which each comprise two plastic parts which fit one into the other and can be locked pivotably by means of a long, additional bolt. The walls of this plastic container can be swung in one after the other, in a certain sequence, towards the base of the container, whereupon they assume a position which is virtually parallel to said base. The disadvantage with using such a container, for example, for loose goods such as vegetables, fruit and the like is that there are only two walls and that these cannot be locked in the upright position. In addition, in order to achieve stable, stackable packing, there is a need for additional straps which have to be positioned, and lashed, in a horizontal direction around the entire plastic container.

The invention is intended to remedy this. The invention, as it is characterized in the claims, provides a plastic container in which the base and walls can be produced separately and can then be assembled. This permits a considerably larger degree of freedom as regards the configuration of these parts, which, moreover, can be produced considerably more easily than an entire, integral plastic container. The container can be dismantled again at a later stage and the parts can be cleaned, for example individually, and also exchanged individually. Nevertheless, unintended disengagement of the parts is not possible. Moreover, the hinge constructed according to the invention does not subject the material to any exceptional loading, with the result that the selection of materials which can be used is considerably larger. Even the use of regenerated material is not ruled out.

Developments according to the invention solve the problem of providing a means for securing the container reliably in its use configuration with the walls upright, which means can nevertheless be readily released if intended. According to the invention, the walls are not only connected by snap-action locking mechanisms, as is known from the document mentioned above, but rather are latched reliably, with the result that they can only be disengaged by releasing the latching connection, whereupon they can readily be swung over into the transporting configuration. Furthermore, abutting side borders of adjacent walls are reliably interconnected with one another, with the result that they withstand even large forces, even from the inside, as exerted, for example, by the weight of goods stored in the container.

Figure 2A:
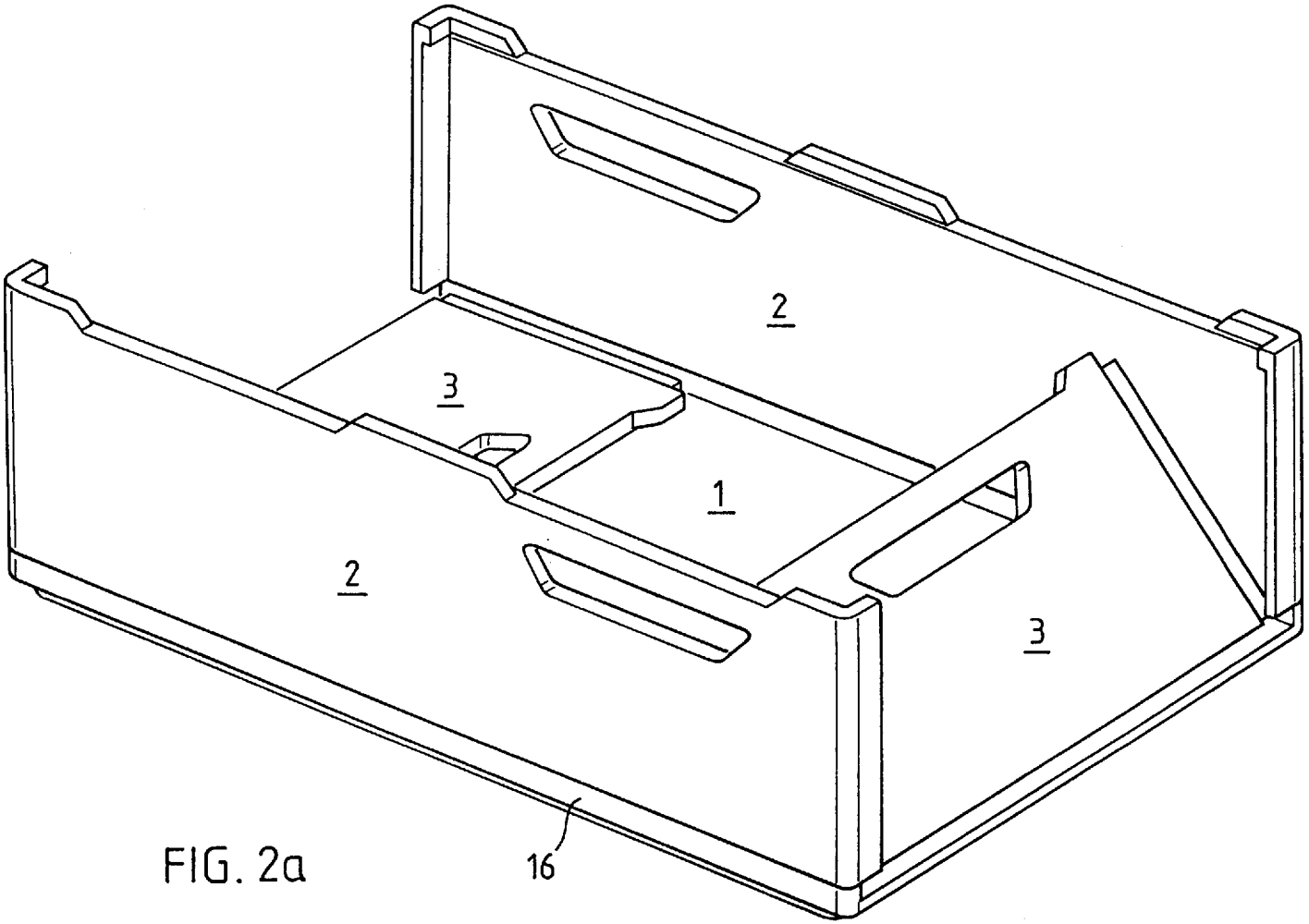
Figure 2B:
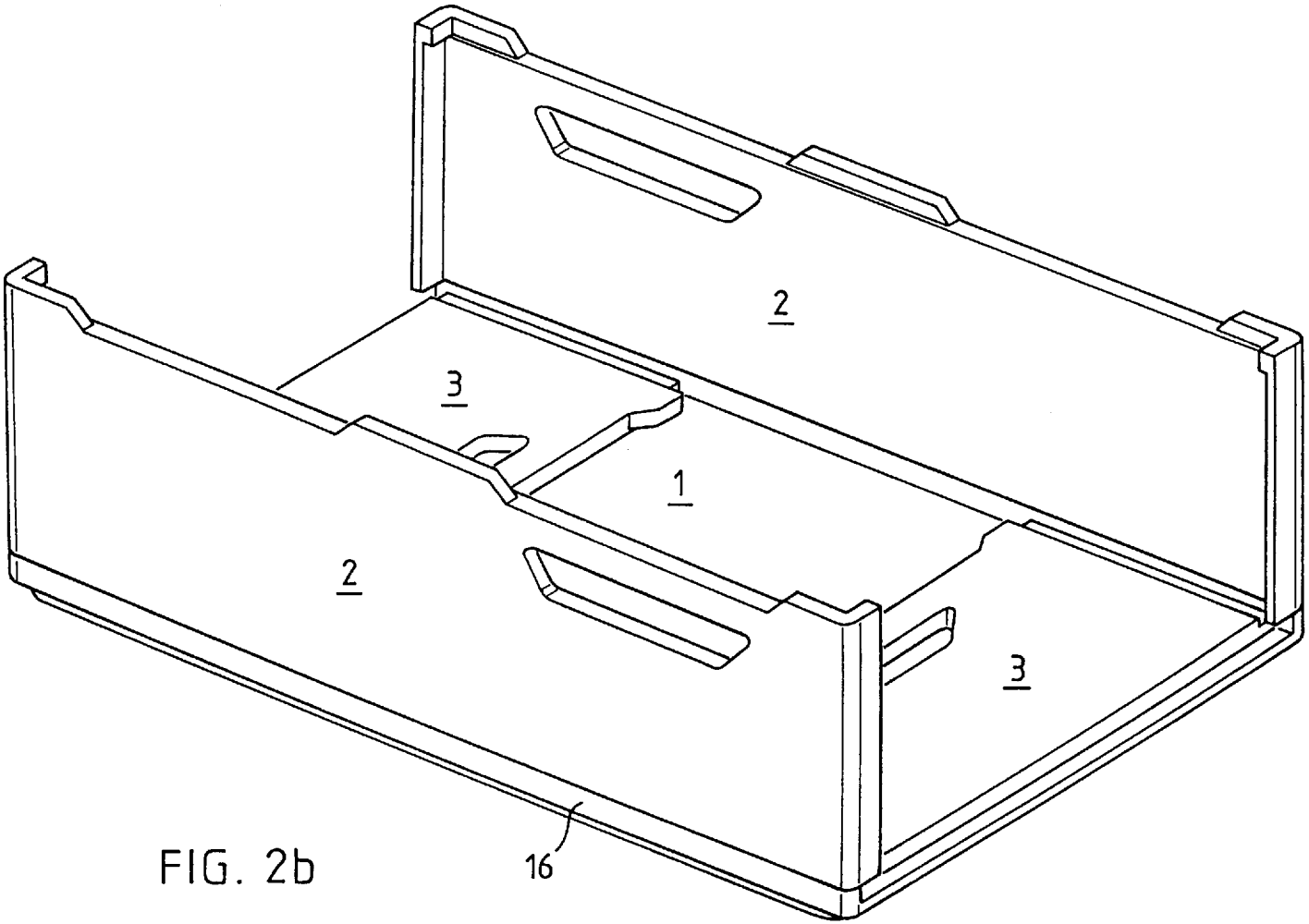
Figure 2C:
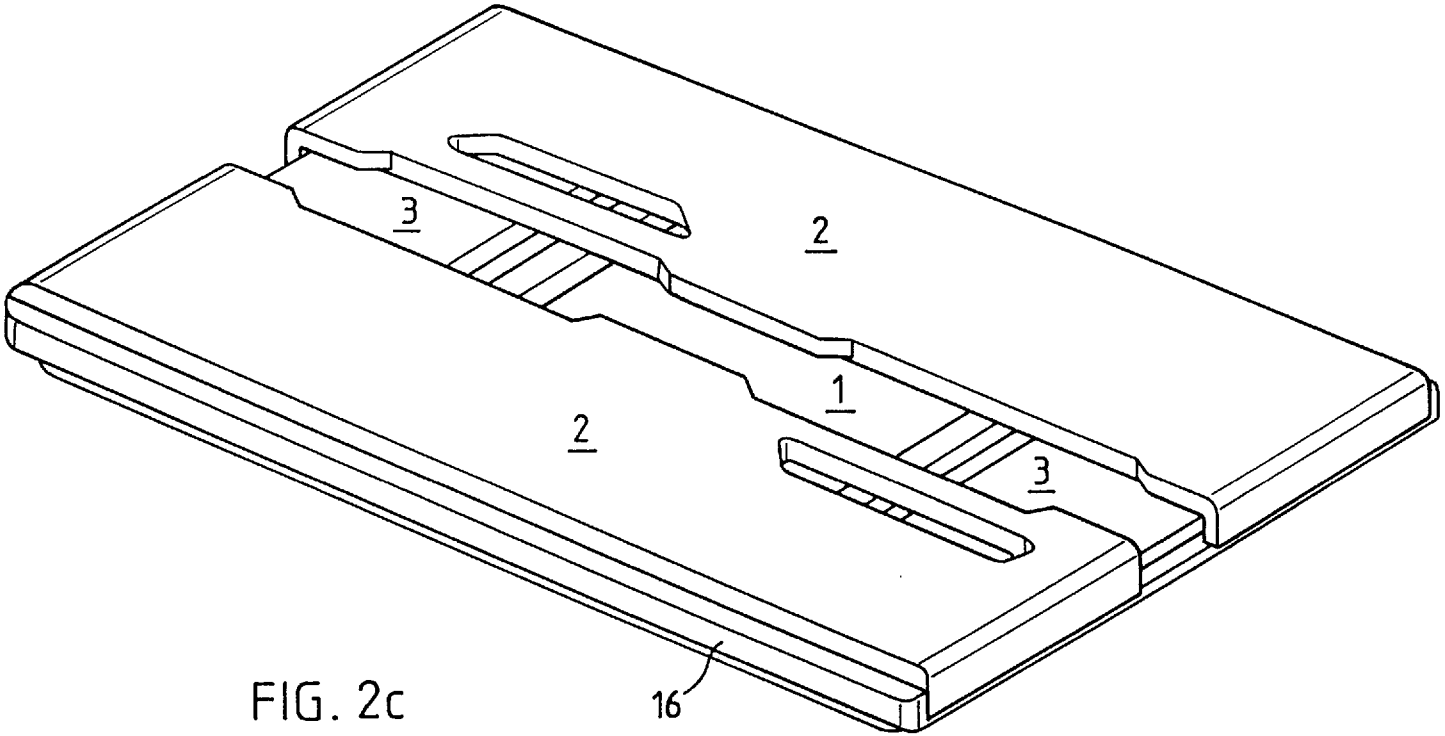
Figure 3:
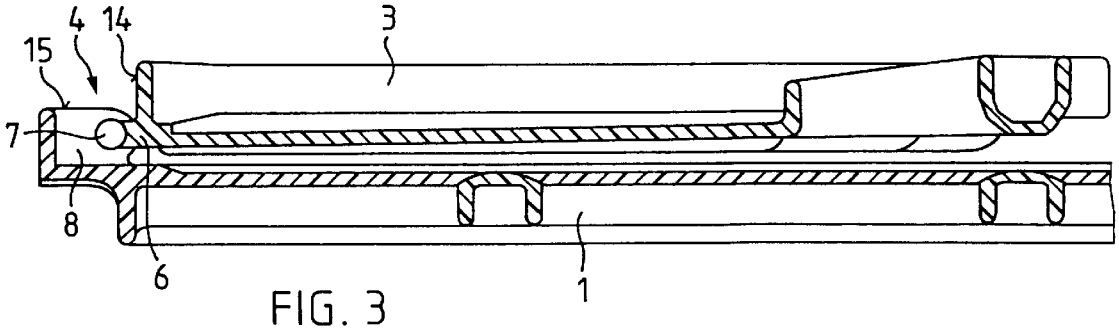

The invention is explained in more detail hereinbelow with reference to an exemplary embodiment, which merely illustrates one way of implementing the invention. In the drawings:

FIG. 1 shows a simplified perspective illustration of a plastic container according to the invention in the use configuration, FIGS. 2*a–c* show simplified perspective illustrations of the stepwise operation for transferring the plastic container of FIG. 1 into the transporting configuration illustrated in FIG. 2*c,* in which the walls have been swung over, FIG. 3 shows a partial longitudinal section through the plastic container in the transporting configuration according to FIG. 2*c,*

Figure 4A:
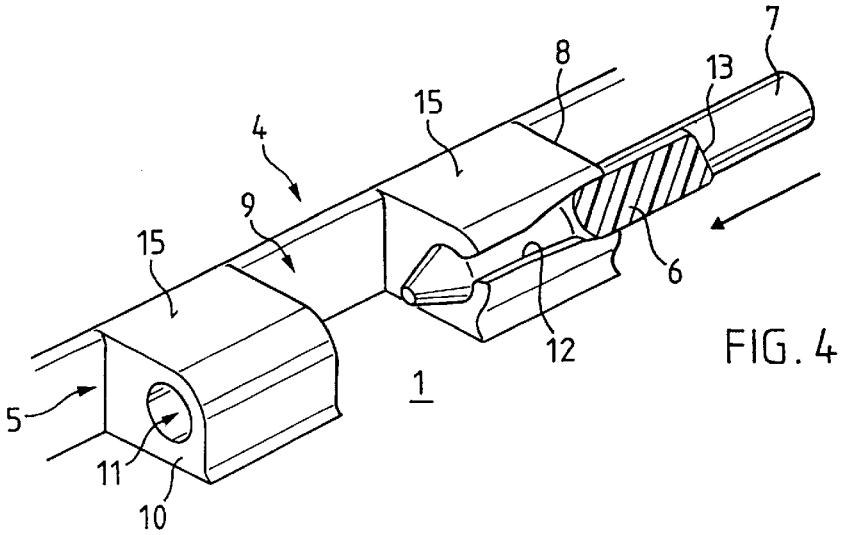
Figure 4B:
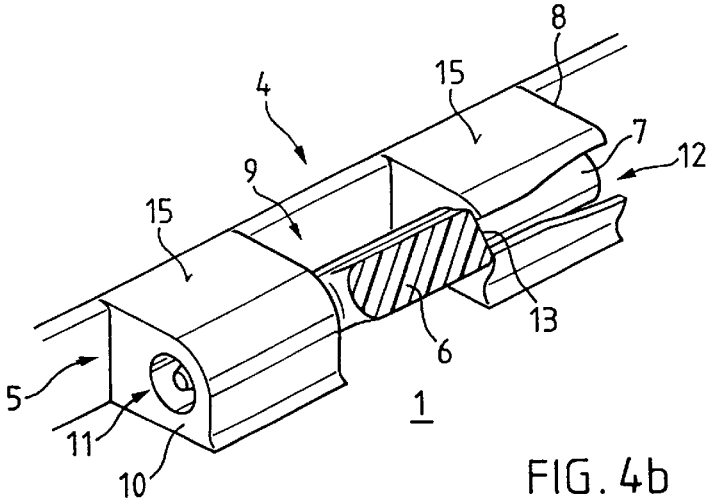
Figure 4C:
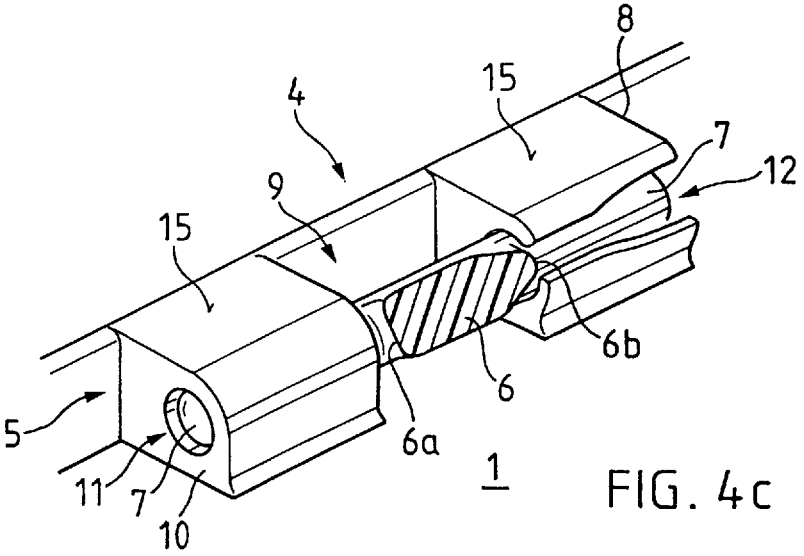
Figure 6:
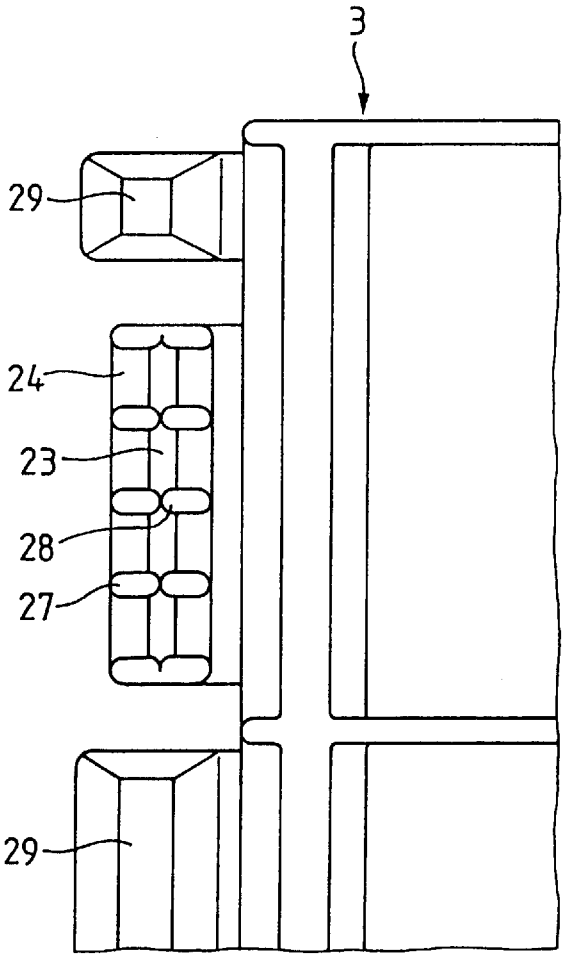
Figure 5:
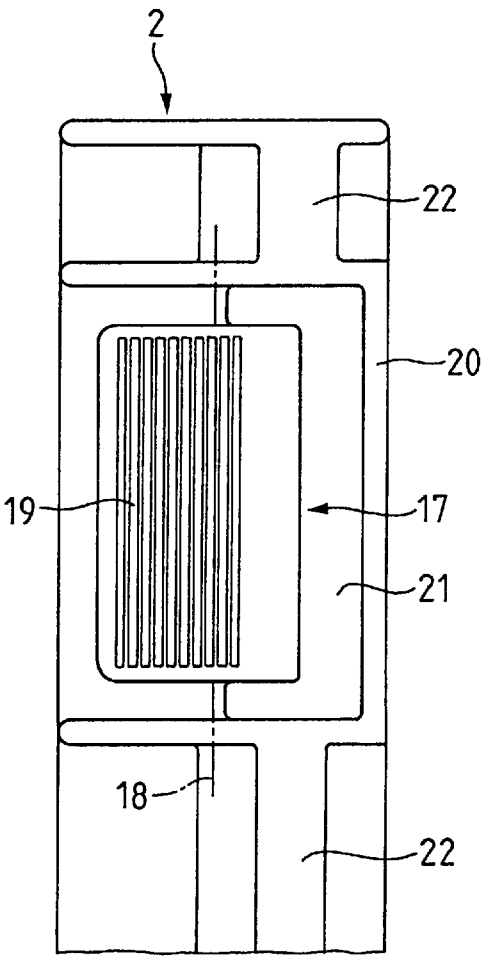
Figure 7:
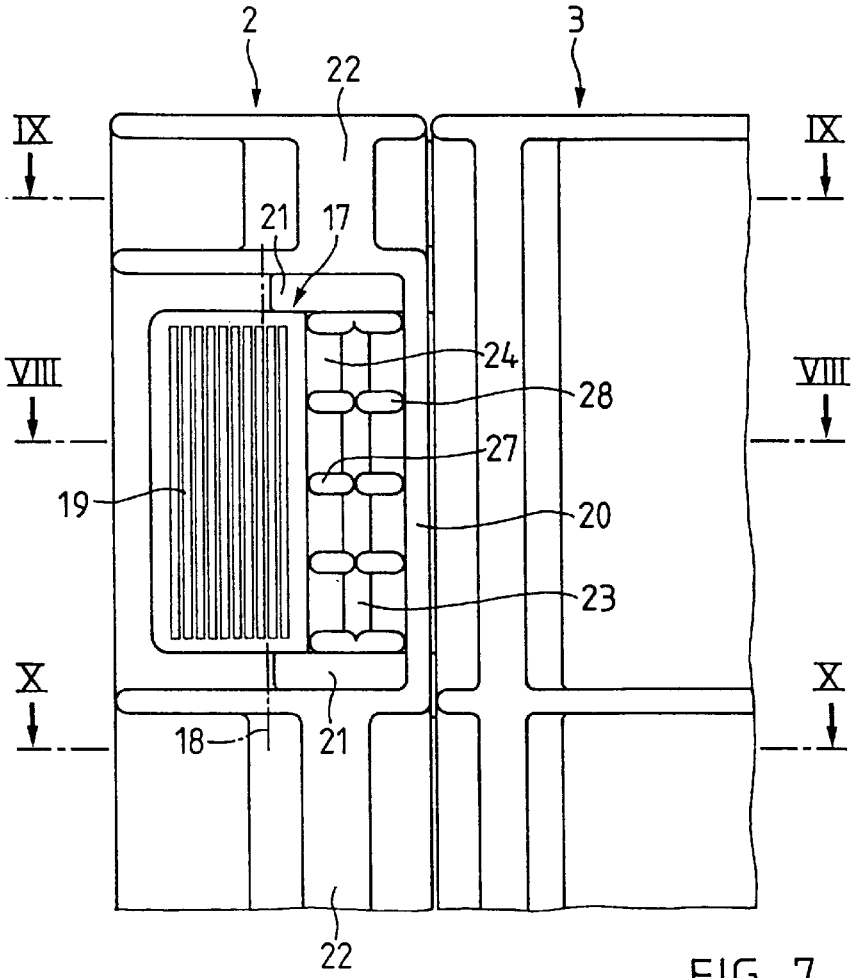
Figure 8:
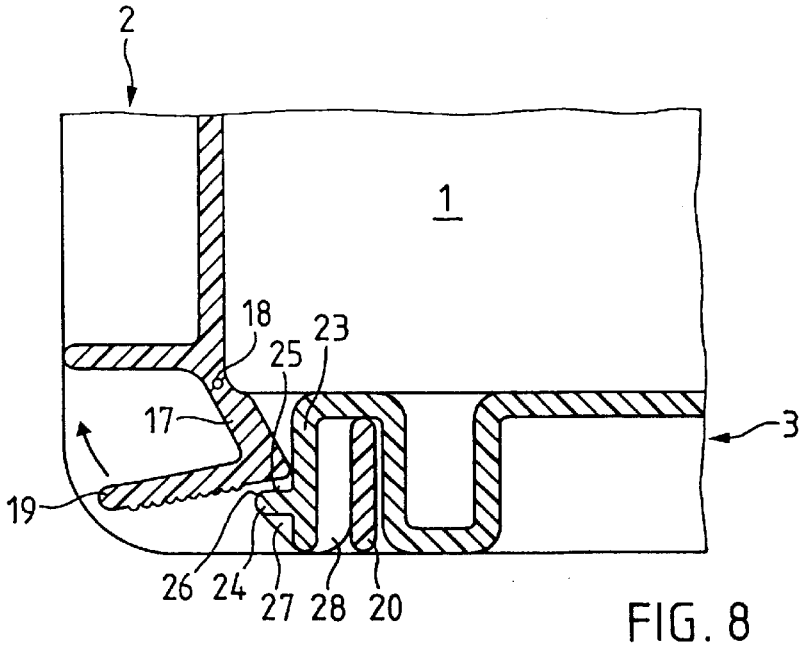
Figure 9:
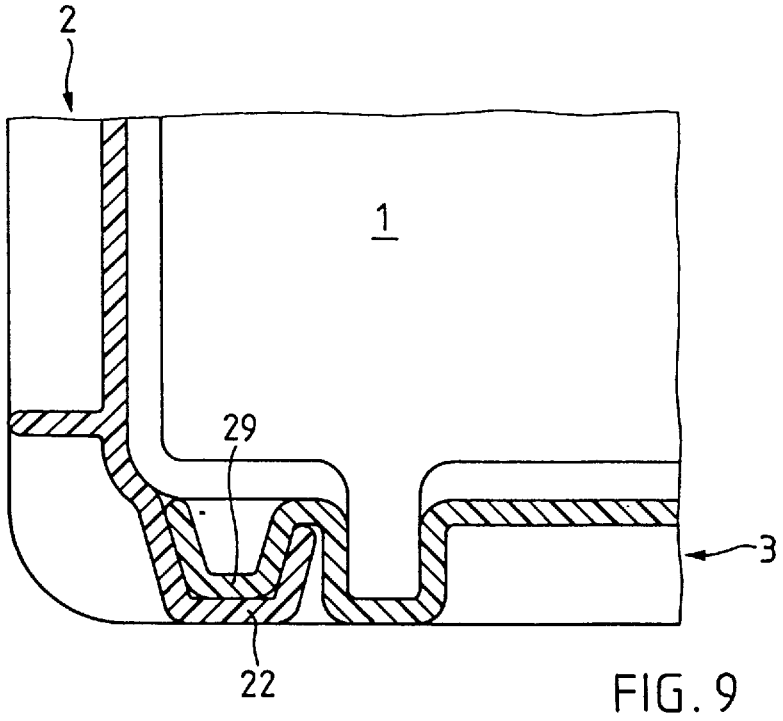
Figure 10:
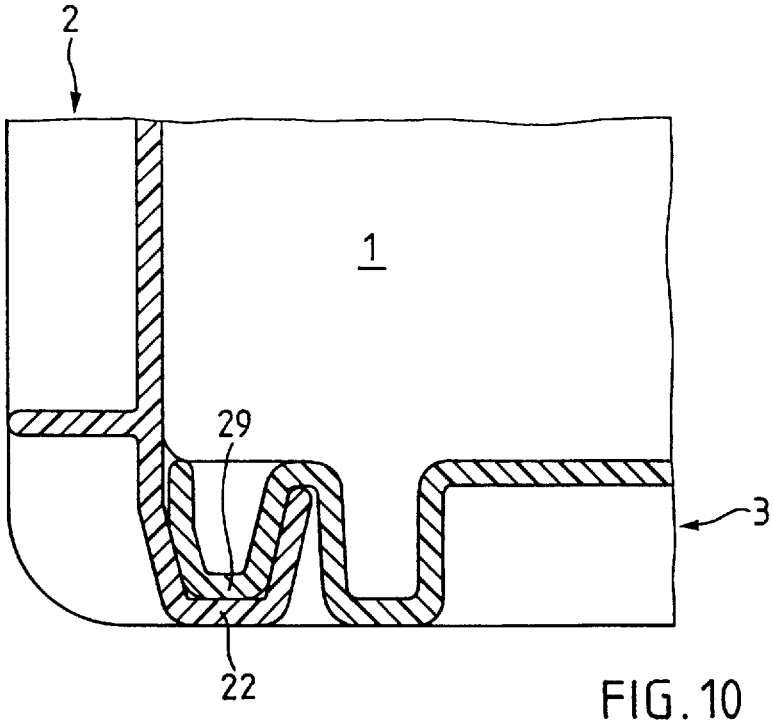
Figure 12:
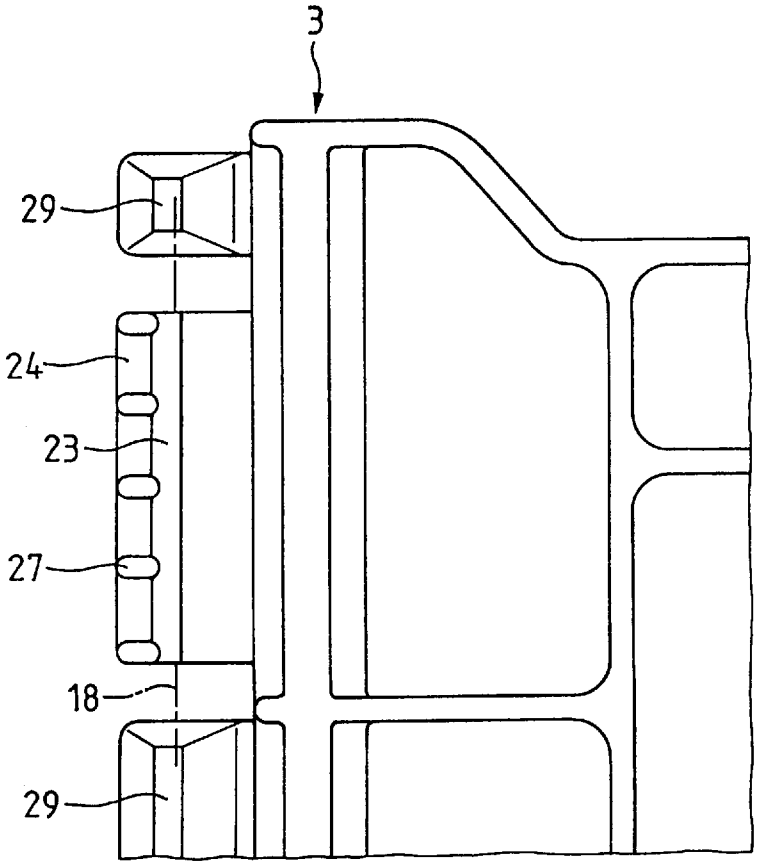
Figure 11:
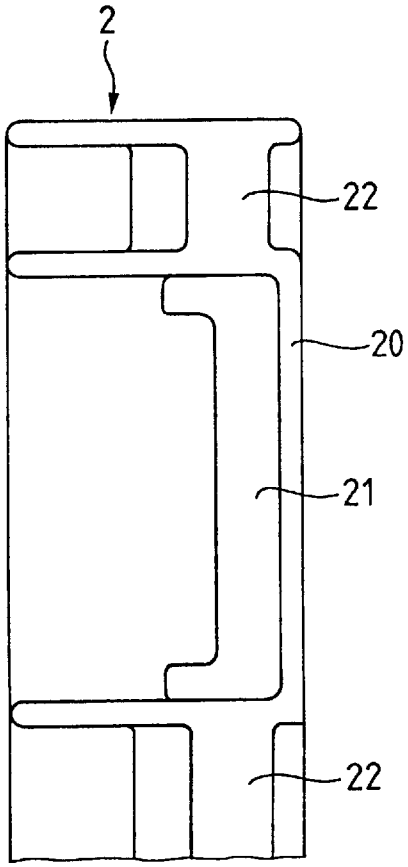
Figure 13:
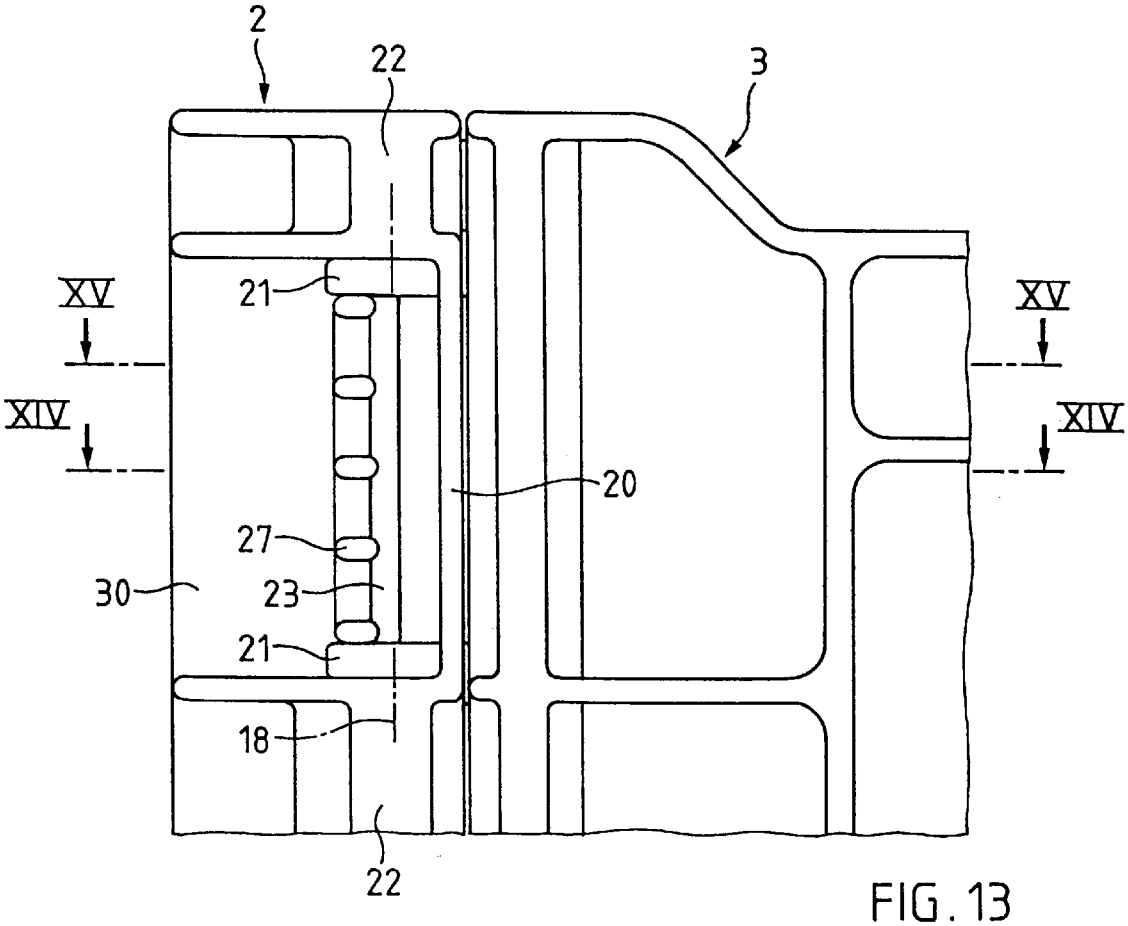
Figure 14:
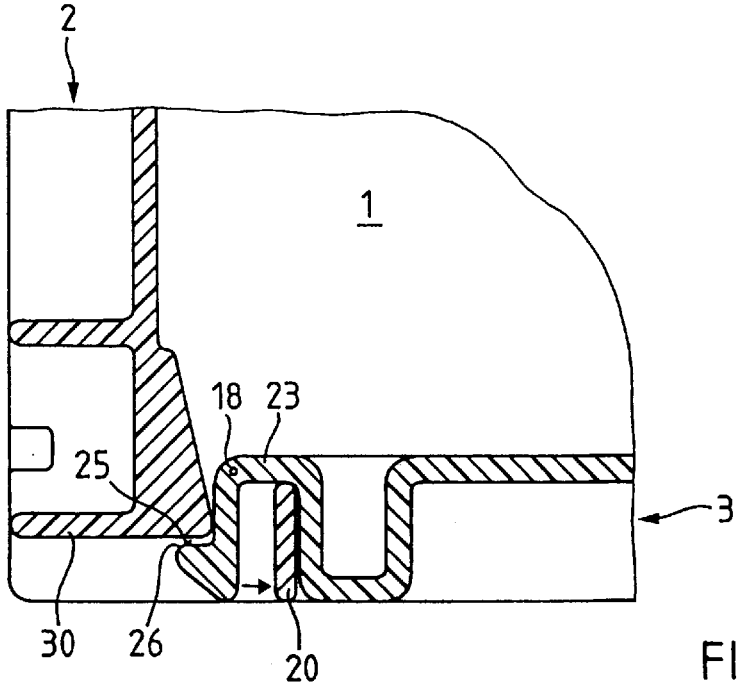
Figure 15:
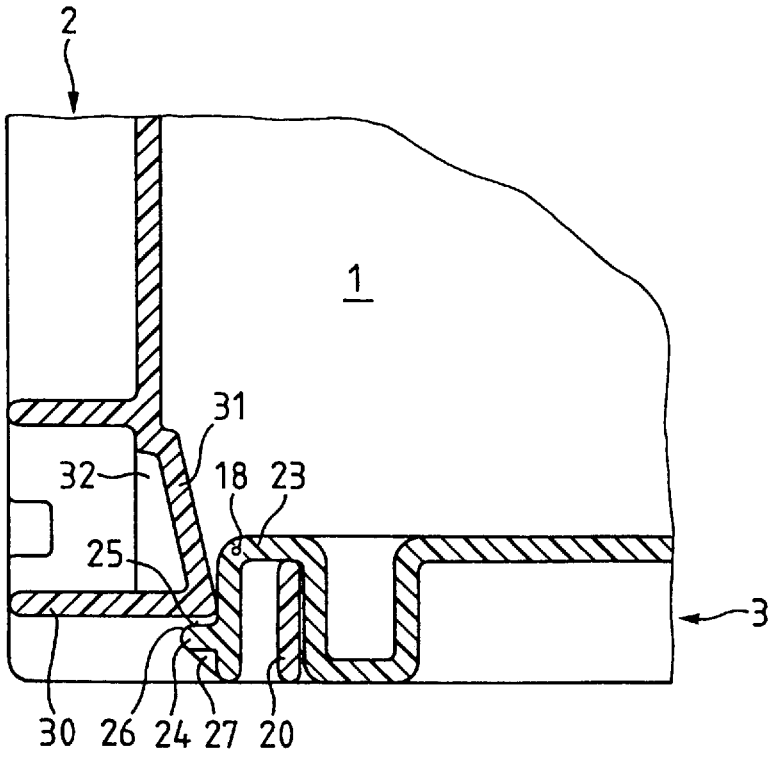

FIGS. 4*a, b* show a hinge in the operation of a wall being plugged together with the base, FIG. 4*b* showing the end position, FIGS. 4*c, d* show further embodiments of a hinge in the operation of a wall being plugged together with a base, the end position being shown in both cases, FIG. 5 shows an end-face elevation of the top corner region of a side wall of a first embodiment of the plastic container according to the invention, FIG. 6 shows an end-face elevation of the top corner region of an end wall of the first embodiment of the plastic container according to the invention, FIG. 7 shows the top corner regions according to FIGS. 6, 7 in engagement, FIG. 8 shows a section along VIII—VIII in FIG. 7, FIG. 9 shows a section along IX—IX in FIG. 7, FIG. 10 shows a section along X—X in FIG. 7, FIG. 11 shows an end-face elevation of the top corner region of a side wall of a second embodiment of the plastic container according to the invention, FIG. 12 shows an end-face elevation of the top corner region of an end wall of the second embodiment of the plastic container according to the invention, FIG. 13 shows a top corner region according to FIGS. 11, 12 in engagement, FIG. 14 shows a section along XIV—XIV in FIG. 13, and FIG. 15 shows a section along XV—XV in FIG. 13.

The plastic container according to the invention, which is illustrated in the use configuration in FIG. 1, comprises a rectangular base 1, whose longitudinal sides have side walls 2 articulated to them and whose broad sides have end walls 3 articulated to them, in each case such that side walls and end walls can be swung inwards, as will be explained in more detail at a later point in the text. The side walls 2 are extended some way around the corners and are blocked by the end walls 3, with the result that they cannot be swung over when the end walls 3 are upright. By contrast, the end walls 3 are free and, after the release of a latching connection with the side walls 2, which will likewise be explained in more detail, can be swung over inwards into a position parallel to the base 1, as is illustrated in FIGS. 2*a,* 2*b.* The side walls 2 are thus unblocked and can then likewise be swung over inwards, with the result that they come to lie on the end walls 3, likewise parallel to the base 1, as is shown in FIG. 2*c.*

The end walls 3 are each connected to the base 1 by means of, for example, two hinges 4 (FIGS. 3, 4*a, b, c, d*), which are arranged at the bottom border of the insides of said end walls. As can be seen most clearly from FIGS. 4*a, b, c, d,* each hinge 4 comprises a hinge housing 5, which is integrally formed on the base 1, and a cylindrical hinge pin 7 which is integrally formed on the end wall 3 and is connected to the latter by a web-like retaining finger 6. The hinge housing 5 comprises a push-in section 8 and an end section 10, which is spaced apart from said push-in section by a gap 9. A rectilinear passage 11 of round, constant cross-section passes through said two sections. In the end section 10, this passage is closed around the circumference and, in the push-in section 8, it has, rotated, with respect to the plane of the base 1, by approximately 30° for the side walls and approximately 90° for the end walls, a push-in slot 12, which narrows in the push-in direction (arrow), i.e. towards the gap 9.

In a first embodiment, the retaining finger 6 is tapered by a rounded portion at its front end, as seen in the push-in direction, and it has, at its rear end, a locking surface 13 which is perpendicular with respect to the axis of the hinge pin 7 and is wider than the front end of the push-in slot 12.

In order for an end wall 3 to be plugged together with the base 1, said end wall 3 is thus inclined at approximately 30° with respect to the base and the hinge pin 7 is then pushed into the passage 11, which may be facilitated by an optionally provided, conically tapering tip at the front end of the hinge pin, the retaining finger 6 finally penetrating, by means of its tapered front end, into the push-in slot 12, which is wider at its rear end than the retaining finger 6, with the result that the latter can be introduced very easily. The end wall 3 continues to be pushed, with the push-in section 8 of the hinge housing 5 being deformed elastically by the retaining finger 6, until the retaining finger 6 is located in the gap 9 (FIG. 4*b*) and, since the front end of the push-in slot 12 is narrower than the locking surface 13 at the rear end of the retaining finger 6, is secured against sliding back. Unintended separation of the end wall 3 from the base 1 is thus ruled out. Since the retaining finger 6 is only slightly shorter, in the push-in direction, than the gap 9, there is only a very small amount of play in this direction.

If the end wall 3 is to be separated from the base again, then the push-in slot 12 can be widened elastically at its front end by means of a suitable tool and the retaining finger 6 can then be drawn out, counter to the push-in direction, through the push-in slot 12 and the hinge pin 7 can be drawn out of the hinge housing 5.

In a second embodiment, the retaining finger 6 has a vertical stop surface 6*a* at its front end, as seen in the push-in direction, and a tapered portion 6*b* at its rear end, which tapered portion is narrower than that end of the push-in slot 12 which adjoins the gap 9.

In order for a side wall 2 to be plugged together with the base 1, said side wall is inclined at approximately 30° with respect to the base and the hinge pin 7 is then pushed into the passage 11, which, despite the stop surface 6*a* at the front, can be easily executed by striking the rear vertical edge of the side wall 2, as seen in the push-in direction, by hand. In this arrangement, the side wall 2 continues to be pushed, with the push-in section 8 of the hinge housing 5 being deformed elastically by the retaining finger 6, until the retaining finger 6 is located in the gap 9 (FIG. 4*c*) and the stop surface 6*a* strikes against the end section 10. Despite the fact that the front end of the push-in slot 12 is wider than the tapered portion 6*b* at the rear end of the retaining finger 6, the side walls 2 are secured against sliding back because the rigidity of the push-in section 8 provides sufficient resistance to a sliding-out action; in addition, it is only possible for the side wall to be pushed out when it is at the known angle of inclination of approximately 30° with respect to the base. Unintended separation of the side wall from the base 1 is thus ruled out. Since the retaining finger 6 is only slightly shorter, in the push-in direction, than the gap 9, there is only a very small amount of play in this direction.

If the side wall 2 is to be separated from the base again, then the push-in slot 12 can be widened elastically at its front end by means of the tapered portion 6*b* at the rear end of the retaining finger, and by lightly striking the corresponding vertical edge at the front edge of the side wall 2 by hand, and then the retaining finger 6 can be drawn out, counter to the push-in direction, through the push-in slot 12 and the hinge pin 7 can be drawn out of the hinge housing 5. In this exemplary embodiment, the positioning of the tapered portion 6*b* on the rear side of the retaining finger 6 has an advantageous effect since it is then possible to dispense with a special auxiliary tool for the purpose of dismantling the container.

Advantages of the two preceding embodiments are combined in a third embodiment. The retaining finger 6 has a tapered portion 6*b* both at its front end, as seen in the push-in direction, and at its rear end, which tapered portion is narrower than the front end of the push-in slot 12.

Figure 4D:
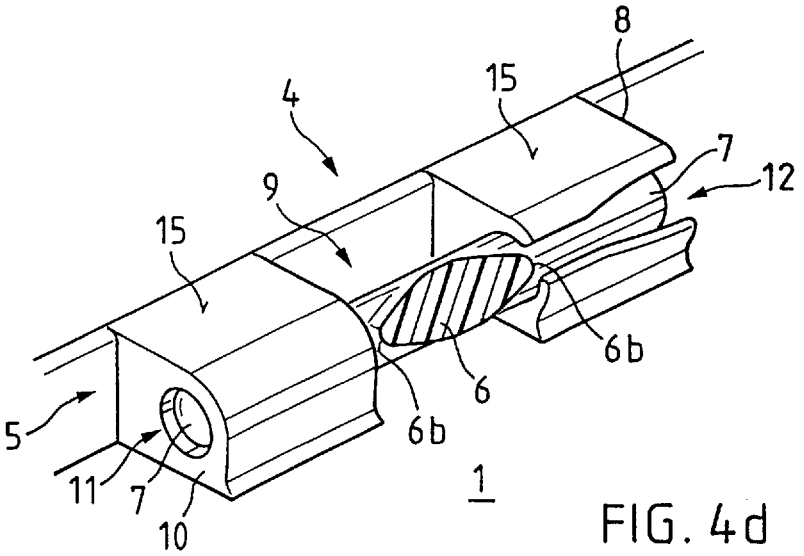

In order for a side wall 2 to be plugged together with the base 1, said side wall is inclined at approximately 30° with respect to the base and the hinge pin 7 is then pushed into the passage 11, which, by virtue of the tapered portion 6*b* at the front and by lightly striking the rear vertical edge of the side wall 2, as seen in the push-in direction, by hand, can easily be executed. In this arrangement, the side wall 2 continues to be pushed, with the push-in section 8 of the hinge housing 5 being deformed elastically by the retaining finger 6, until the retaining finger 6 is located in the gap 9 (FIG. 4*d*) and the leading tapered portion 6*b* strikes against the end section 10. Despite the fact that the front end of the push-in slot 12 is wider than the tapered portion 6*b* at the rear end of the retaining finger 6, the end walls 3 and the side walls 2 are secured against sliding back because the rigidity of the push-in section 8 provides sufficient resistance to a sliding-out action; in addition, it is only possible for the side wall to be pushed out when it is at the known angle of inclination of approximately 30° with respect to the base. Unintended separation of the side wall from the base 1 is thus ruled out. Since the retaining finger 6 is only slightly shorter, in the push-in direction, than the gap 9, there is only a very small amount of play in this direction.

If the side wall 2 is to be separated from the base again, then the push-in slot 12 can be widened elastically at its front end by means of the tapered portion 6*b* at the rear end of the retaining finger, and by lightly striking the corresponding vertical edge at the front end of the side wall 2 by hand, and then the retaining finger 6 can be drawn out, counter to the push-in direction, through the push-in slot 12 and the hinge pin 7 can be drawn out of the hinge housing 5. In this exemplary embodiment, the positioning of the tapered portion 6*b* on both sides of the retaining finger 6 has an advantageous effect since it is then possible to dispense with a special auxiliary tool for the purpose of dismantling the container and the necessary force for the purpose of reassembling the container is lower. The mechanical loading to which the elastic push-in slot is subjected by repeatedly assembling and separating the base and side walls 2 is thus minimized.

The operations of assembling the side walls 3 with the base 1 and of separating the same take place analogously in all three of said embodiments, the only condition being that the end walls 3 have to be approximately perpendicular with respect to the base 1. A sliding-out action of the end wall 3 in any position up to the vertical is normally prevented by the side walls 2, which have to be put in the upright position first; in the horizontal position, the sliding-out action is prevented by the rims 16. The end walls 3 can thus only be removed, in a specific and deliberate manner, when at least one side wall 2 has already been removed.

With the hinge pin 7 pushed in to the full extent (FIGS. 4*b, c, d*), the end wall 3 can be moved into a vertical position, as in the use configuration according to FIG. 1, and can also be swung over into the transporting configuration of FIGS. 2*c* and 3. The section in FIG. 3 is taken through the centre plane of a hinge 4, the hinge pin 7 being illustrated in a non-sectioned state. The side walls have been omitted.

The end walls 3 are already secured against tilting outwards in that they are seated, by means of parts of an abutment strip 14, on stop surfaces 15 on the upper sides of the hinge housings 5.

The side walls 2 are connected to the base 1 via exactly identical hinges, which are likewise arranged at the bottom border of the insides of said side walls. The side walls 2 are seated, in a somewhat elevated manner, on rims 16 (FIGS. 1, 2*a–c*), which likewise form stops against said walls tilting outwards, with the result that the hinges are also arranged at a somewhat higher level and, in the transporting configuration, the side walls 2 rest on the end walls 3, parallel to the base 1.

The base and the walls of the plastic container can be produced separately, in accordance with what has been described above, and then simply plugged together—without the aid of a tool—for use. They can be separated again by means of a suitable tool if required, e.g. for cleaning purposes, and then reassembled without the aid of a tool.

In order to latch an end wall 3 to the two abutting side walls 2 in the use configuration, it is the case that, according to a first embodiment of the plastic container according to the invention (FIGS. 5–8), the side wall 2, which is extended some way around the corner, is provided in each case, in the top part of the side-border region, with a catch 17, as latching part, which is designed as a rigid rectangular plate which projects outwards towards the side border and the end wall 3 and is integrally formed on the side wall 2 such that it can be pivoted elastically around a latching axis 18 which is approximately parallel to the abutting side borders of the walls, that is to say vertical in the case described here. In this location, the catch 17 has a weakened strip which elastically absorbs slight shearing forces and deformation forces which occur as it is pivoted. On its front edge, the catch 17 bears a release grip 19, which is likewise in the form of a plate, is connected rigidly to the catch and projects beyond the latching axis 18, approximately parallel to the end wall 3. Right on the outside of the side border, the side wall 2 has a frame web 20 which is parallel to the catch 17, is spaced apart slightly from the latter and, together with the catch 17, laterally bounds an elongate window 21. Beneath the catch 17, the side wall 2 is provided with a hook profile 22 which extends approximately as far as the bottom border of said side wall and continues in the narrow, top border region above the catch 17.

Level with the catch 17, the end wall 3 has, likewise in the side-wall region, a hook extension 23 which engages with the side wall 2 by means of a web which projects through the window 21 at right angles to the plane of the end wall 3 and bears a latching web 24 directed towards the catch 17. The inwardly directed rear side of the latching web 24 forms a narrow strip which (see FIG. 8), as latching surface 25, interacts with the catch 17 as locking element. At its free border directed towards the side wall 2, the latching surface 25 is bounded by a latching edge 26 and, at its opposite border, it is bounded by a stop formed by the hook extension 23. A plurality of triangular tapered webs 27 are arranged on the front side, between the latching web 24 and the outermost part of the hook extension 23, and continue, on the other side of said hook extension, as rounded supporting webs 28 which butt against the framework 20. Above the hook extension 23, and beneath the same, virtually as far as the bottom border, the end wall 3 has an outwardly projecting bead 29, which is enclosed by the hook profile 22 of the side wall 2 (see also FIGS. 9, 10).

In the use configuration, the front edge of the catch 17 is spaced apart slightly from the latching surface 25. It is only if pressure is exerted on the end wall 3 in the swing-over direction, that is to say inwards, that the latching surface 25 is pressed against the front edge of the catch 17, as a result of which the latter is rotated, with deformation in the region of the latching axis 18, around the latter towards the stop formed by the hook extension 23. The latching connection is thus self-locking.

In order to release the latching connection, the release grip 19 (see FIG. 8) is pressed (arrow) in the swing-over direction, i.e. inwards, as a result of which the catch 17 is rotated around the latching axis 18 towards the latching surface 25, with the result that its front edge butts against said latching surface and, with elastic deformation, in particular, of the catch 17 in the region of the latching axis 18—the hook extension 23 is strengthened by the supporting webs 28 and supported on the border web 20, and is thus at most only slightly deformable—is pushed out beyond the latching edge 26 and disengaged. As soon as the latching connections on the two side borders have been released in this manner, the free end wall 3 can be swung over inwards, i.e. towards the base 1, around its hinge 4, as is illustrated in FIGS. 2*a–c* and 3. After the two end walls 3 have been swung over, the side walls 2 are also unblocked and can be swung over the end wall 3. This thus achieves the transporting configuration of FIG. 2*c*.

For the purpose of swinging up the walls to produce the use configuration of FIG. 1, the end walls 3 are swung up after the side walls 2 have been swung up, the hook extension 23 being pushed into the window 21. In this arrangement, said hook extension butts against the catch 17 by means of the tapered webs 27 and rotates the catch outwards around the latching axis 18 until, finally, it moves past the latching edge 26 and snaps into the latching position, which can be seen from FIG. 8. This operation can be assisted by pulling on the release grip 19.

In the use configuration, it is not possible for the plastic container according to the invention to be collapsed or spread apart even by large forces. The self-locking action of the latching connections, which has already been explained, acts against any pressure exerted inwards. Any pressure exerted outwards, that is to say counter to the swing-over direction, is counteracted not only by the likewise above-mentioned supports of the walls on the base, but also—independently of the latching connections—by the interconnection of the side walls 2 with the end walls 3 in the region of the abutting side borders. For example, the action of the hook profile 22 of the side wall 2 engaging around the bead 29 of the end wall 3, virtually over the entire length of the side borders, means that both the side wall 2 and the end wall 3 are secured, in a manner which is very effective and counteracts even large forces, against tilting outwards. This securing is assisted by the abovedescribed design of the latching connection, in particular the support of the hook extension 23 of the end wall 3 on the border web 20 of the side wall 2.

According to a second embodiment of the plastic container according to the invention (FIGS. 11–15), the latching connection is designed somewhat differently to the first embodiment described above. Apart from the differences emphasized below, however, the embodiments are identical, for which reason you are referred, in this respect, to the description of the first embodiment.

In the second embodiment, the latching part is formed by the hook extension 23 which is anchored on the end wall 3 and, in the same way as in the first embodiment, bears a latching web 24 whose inwardly directed rear side forms a latching surface 25, and which—the supporting webs 28 of the first embodiment are absent here—can be pivoted elastically around a latching axis 18. Engaging, as locking element, with the latching surface 25 is a locking plate 30 which is connected rigidly to the side wall 2 and engages behind the latching surface 25. In order to strengthen the locking plate, in particular in the region of the edge directed towards the latching surface 25, a supporting plate 31 makes contact there (see FIG. 15) at an acute angle with the blocking plate 30. For the purpose of further strengthening, the locking plate 30 and the supporting plate 31 are connected at the top and bottom ends, and halfway up, by triangular strengthening ribs 32.

In order to release the latching connection, the tip of the hook extension 23 is pivoted to the right (arrow), with elastic deformation of the same, with the result that the latching surface 25 is disengaged from the locking plate 30. Conversely, when the end wall is swung up, the hook extension 23 butts against the supporting plate 31 by means of the tapered webs 27 and yields, by pivoting elastically around the latching axis 18, until, once the latching web 24 has been pushed past the locking plate 30, it snaps back into its basic position and engages around the edge of said locking plate by means of the latching web 24. Although the latching connection according to the second embodiment is not self-locking in the sense of that of the first embodiment, it is, nevertheless, likewise very reliable and has the advantage of easy operability since the operation of releasing the latching connection and simultaneously swinging over the end wall 3 is simplified by the hook extension 23, as the latching part which is to be pivoted, being located in the vicinity of the end wall 3.

Finally, it should be pointed out that, although the features set down in the claims work together particularly advantageously, hinges such as those defined in the characterizing part of claim 1 and in claims 2 to 7 can be used not just in collapsible plastic containers, but also, quite generally, for connecting two plastic parts which can be pivoted with respect to one another.

Conversely, the latching connections outlined in the characterizing part of claim 8 and in claims 9 to 23 can be used in conjunction with plastic containers of the generic type irrespective of the manner in which the walls are connected, for swing action, to the base. In the same way, the interconnection of the side walls according to the characterizing part of claim 24 and claims 25 to 27 can be used in plastic containers of the generic type irrespective of the design of this connection and of the latching connection.

I claim:

1. Collapsible plastic container having a base (1) and a plurality of walls which are each connected to the base (1), via at least one hinge (4), such that they can be swung into a position which is at least approximately parallel to said base, the hinge (4), on the one hand, comprising a hinge housing (5) with at least one push-in section (8) and an end section (10), following one after the other in a push-in direction and separated by a gap (9), and with a passage (11) which, as seen in the push-in direction, passes through the entire push-in section (8) and at least part of the end section (10), and, on the other hand, comprising a hinge pin (7) which is mounted rotatably in the passage (11) so as to overlap with the end section (10) and the push-in section (8), characterized in that in the region of the push-in section (8), the passage (11) is open at the sides as a result of a push-in slot (12) extending over the entire length of said push-in section, in the region of the gap (9), the hinge pin (7) is retained laterally by a retaining finger (6), the retaining finger (6) having, at its end which is directed towards the push-in section (8), a locking surface (13) which is wider than that end of the push-in slot (12) which adjoins the gap (9), but can be pushed through the push-in slot (12), with the push-in section (8) being deformed elastically in the process.

2. Plastic container according to claim 1, characterized in that the front end of the retaining finger (6), as seen in the push-in direction, is narrower than the rear end of the push-in slot (12), as seen in the push-in direction.

3. Plastic container according to claim 1, characterized in that the retaining finger (6) is designed as a web which tapers at its front end, as seen in the push-in direction.

4. Plastic container according to claim 1, characterized in that the retaining finger (6) has a vertical stop surface **(6*a*) at its front end, as seen in the push-in direction, and a tapered portion (6*b*) at its rear end, as seen in the push-in direction, which tapered portion is narrower than that end of the push-in slot (12) which adjoins the gap (9), but can be pushed through the push-in slot (12), with the push-in section (8)** being deformed elastically in the process.

5. Plastic container according to claim 1, characterized in that the retaining finger (6) has a tapered portion **(6*b*) both at its front end, as seen in the push-in direction, and at its rear end, which tapered portion is narrower than that end of the push-in slot (12) which adjoins the gap (9), but can be pushed through the push-in slot (12), with the push-in section (8)** being deformed elastically in the process.

6. Plastic container according to claim 1, characterized in that, in the region of the end section (10), the passage (11) is closed around the circumference.

7. Plastic container according to claim 1, characterized in that the push-in slot (12) narrows in the push-in direction.

8. Plastic container according to claim 1, characterized in that each wall is either blocked by at least one adjoining wall, with the result that it can only be swung over inwards after said adjoining wall has been swung over, or is free, but adjoins at least one blocked wall and is latched releasably thereto in the region of the abutting side borders by one wall being provided, transversely with respect to the inwardly oriented swing-over direction of the free wall, with a latching surface (25) with which a locking element of the other wall forms a latching connection, which can be released by elastic deformation of a latching part.

9. Plastic container according to claim 8, characterized in that the latching part can be pivoted elastically around a latching axis (18).

10. Plastic container according to claim 8, characterized in that the latching surface (25) is formed by a latching web (24) anchored on one wall.

11. Plastic container according to claim 8, characterized in that the latching surface (25) projects laterally from a protrusion directed parallel to the swing-over direction of the free wall.

12. Plastic container according to claim 8, characterized in that the locking element is designed as a plate which extends in an elongate manner in the direction of the latching axis (18), and the latching surface (25) is designed as a strip parallel to the latching axis (18).

13. Plastic container according to claim 11, characterized in that the protrusion projects through a window (21) in the other wall.

14. Plastic container according to claim 8, characterized in that the elastically pivotable latching part is designed as a catch (17), which is anchored on the other wall and is directed, as locking element, obliquely with respect to the latching surface (25), and the latching axis (18) is offset with respect to the latching surface (25) such that disengagement can be effected by pivoting the catch (17) towards the latching surface (25), beyond a latching edge (26) which bounds the latter.

15. Plastic container according to claim 14, characterized in that, at its border which is located opposite the latching edge (26), the latching surface (25) is bounded by a stop.

16. Plastic container according to claim 14, characterized in that the catch (17) can be deformed elastically in the region of the latching axis (18) and is otherwise rigid.

17. Plastic container according to claim 14, characterized in that, for disengagement purposes, the catch (17) bears a release grip (19) which is integrally formed in the region of the border directed towards the latching surface (25) and projects beyond the latching edge (26).

18. Plastic container according to claim 17, characterized in that the release grip (19) is designed as an extension which is connected rigidly to the catch (17).

19. Plastic container according to claim 18, characterized in that the release grip (19) projects beyond the latching axis (18), transversely with respect to the swing-over direction, with the result that disengagement can be initiated by exerting pressure on said release grip.

20. Plastic container according to claim 17, characterized in that the release grip (19) is designed as a plate which is approximately parallel to the latching surface (25).

21. Plastic container according to claim 8, characterized in that the latching surface (25) is provided on the elastically pivotable latching part.

22. Plastic container according to claim 21, characterized in that the locking element is designed as a locking plate (30) which is directed transversely with respect to the swing-over direction of the free wall and engages behind the latching surface (25).

23. Plastic container according to claim 22, characterized in that, in the region of an edge oriented towards the latching surface (25), the locking plate (30) is connected to a supporting plate (31) which is anchored on the other wall and is directed obliquely with respect to the latching surface (25).

24. Plastic container according to claim 8, characterized in that each free wall engages on an adjoining blocked wall by means of a first stop, which acts counter to the swing-over direction of the said free wall.

25. Plastic container according to claim 24, characterized in that the blocked wall engages on the free wall by means of a second stop, which acts counter to the swing-over direction of the said blocked wall.

26. Plastic container according to claim 25, characterized in that the first stop and the second stop are respectively formed by a protrusion and an extension which encloses the latter in a hook-like manner, the protrusion and extension respectively being located in the region of the abutting side borders of the free wall and of the blocked wall.

27. Plastic container according to claim 26, characterized in that the protrusion and the extension are respectively designed as a bead (29) and hook profile (22), each of which extends essentially over the entire height of the respective side border.

28. Plastic container according to claim 8, characterized in that the outer walls are designed, alternately in each case, as blocked and free walls, and each free wall is latched to each of the adjacent blocked walls.

29. Plastic container according to claim 28, characterized in that the outer walls can be swung inwards towards the base (1), and the blocked walls bear the locking elements in each case and the free walls bear the inwardly oriented latching surfaces (25).

30. Plastic container according to claim 1, characterized in that the walls are connected to the hinge pin (7) in each case, while the base (1) bears the hinge housings (5).

* * * * *